US006260237B1

(12) United States Patent
McCue et al.

(10) Patent No.: US 6,260,237 B1
(45) Date of Patent: Jul. 17, 2001

(54) PROTECTIVE CORNER GUARD

(75) Inventors: David S. McCue, Marblehead; Christopher Hickey, North Reading, both of MA (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 09/505,424

(22) Filed: Feb. 16, 2000

Related U.S. Application Data

(60) Provisional application No. 60/120,487, filed on Feb. 18, 1999.

(51) Int. Cl.[7] ..... E04F 13/06

(52) U.S. Cl. ..... 16/404; 49/462; 52/288.1; 248/345.1

(58) Field of Search ..... 16/404; 49/460, 49/462; 52/288.1; 248/345.1

(56) References Cited

U.S. PATENT DOCUMENTS

| | | | | |
|---|---|---|---|---|
| 3,787,922 | * | 1/1974 | Foy et al. | 16/DIG. 13 |
| 4,012,878 | | 3/1977 | Ellingson | 52/288 |
| 4,430,833 | * | 2/1984 | Balzer et al. | 52/288.1 |
| 4,903,449 | * | 2/1990 | Ellingson et al. | 52/288.1 |
| 4,999,233 | * | 3/1991 | Probst et al. | 49/462 |
| 5,297,011 | * | 3/1994 | Triunfol | 362/31 |
| 5,508,078 | * | 4/1996 | Stainaker | 52/288.1 |
| 5,603,140 | | 2/1997 | Pryce | 16/42 |

FOREIGN PATENT DOCUMENTS

| | | | |
|---|---|---|---|
| 3129864A1 | | 2/1983 | (DE) . |
| 4204861C1 | | 3/1993 | (DE) . |
| WO 90/11418 | * | 10/1990 | (WO) . |

* cited by examiner

*Primary Examiner*—Chuck Y. Mah
(74) *Attorney, Agent, or Firm*—Lahive & Cockfield, LLP

(57) ABSTRACT

A corner guard for protecting floor fixtures from the impact of collisions with shopping carts, floor scrubbers, and the like provides for a hollow molded polyethylene body having a single lightweight construction that is anchored to the floor by a leg assembly that is attached to the molded body.

8 Claims, 5 Drawing Sheets

PROTECTIVE CORNER GUARD

This application claim benefit to Provisional application Ser. No. 60/120,487 filed Feb. 18, 1999.

FIELD OF TECHNOLOGY

The present invention relates generally to a corner guard for protecting floor fixtures such as refrigerator cases, product displays, or floor shelving and the like from damage, and more particularly to a corner guard employing a molded body of single-body construction with an extended vertical height for protecting these floor fixtures.

BACKGROUND OF THE INVENTION

In supermarkets and retail stores floor fixtures such as freezer and refrigerator cases, floor shelving and product displays are susceptible to damage due to collisions with shopping carts, floor scrubbers, pallet jacks, and stock carts. For example, freezer and refrigerator cases typically include a glass or transparent plastic door for viewing the product without opening the door. The glass can be shattered or the plastic scratched upon impact with shopping carts or the like. Since the body of many of these floor fixtures is constructed of lightweight aluminum or hardened plastic, it can be easily dented or cracked.

Floor fixtures such as shelving are intended to hold product to be sold, and since space is generally at a premium for most retailers, this shelving is typically densely packed with product. When a collision occurs to the shelving, it is possible that the product may be knocked from the shelf resulting in the breakage of glass containers or the denting of cans. In either case, the retailer incurs a loss of product.

In order to protect floor fixtures from collisions and jarring impacts, supermarkets and retail stores have employed protective guards around the fixtures to prevent these occurrences. These guards are conventionally constructed as a horizontally extending aluminum rail, which is mounted into the floor. These rails may be covered with vinyl or include a vinyl insert to provide for impact absorption or add color to the guard. These guards are positioned around the exposed perimeter of the fixture at a distance sufficient to protect the fixture from impact but not hinder access. These guards, however, provide only a limited range of vertical protection for the floor fixture from collision due to the small vertical extension. If the rails on each side of the fixture are not joined at the corner, the fixture will have increased exposure to damage by collision at the corner position, and the retailer may incur increased maintenance costs to repair the fixture.

Other styles of commonly used protective guards consist of vertical metal posts or formed metal arced shapes that are mounted to the floor. The vertical metal posts do not envelop the corner thus narrowing the zone of protection. While formed metal shapes do have a larger zone of protection than the posts, they are not aesthetically complimentary to the cases and fixtures which they protect.

The ability to clean the guards is an important consideration. For convenience, conventional guardrails require that the rail section be removed from the floor prior to cleaning. Due to their extended length, the rail sections may be awkward to handle, and the two-part construction increases the weight of the rails.

What is needed is an improved molded body for improved protection of floor fixtures, having a single body construction that is lightweight, and easy to clean.

SUMMARY OF THE INVENTION

The invention provides a corner guard for protecting corners of structures from collisions with objects, having a hollow plastic body with a rear wall shaped to conform to the corner of a protected structure, and a front wall shaped to surround the corner. A leg structure is secured to the rear wall, the leg structure having at lease one leg portion for supporting the corner guard on the floor.

In preferred embodiments, the corner guard has a metal horizontal rail secured to the front wall of the body, having a surface that extends outwardly from the front wall.

Preferably, the corner guard body is made from polyethylene.

Also, preferably, the leg structure is an integral metal unit having at least a pair of vertical legs and a horizontal connector joining the pair of legs, the connector abutting the rear wall of the body. The rear wall includes a projecting retainer housing with vertical passages for passage of the vertical legs, and a projecting stop for engaging the leg structure.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions and relationships.

DETAILED DESCRIPTION OF AN ILLUSTRATIVE EMBODIMENT

The improved corner guard according to the present invention consists essentially of a molded, hollow, body to absorb impact forces and protect floor fixtures from collisions. The molded body is constructed of a single material that is preferably a lightweight plastic such as low-density polyethylene for ease of cleaning. Other types of material are considered within the scope of the invention such as other plastics. The requirement is that the material must be sturdy enough to absorb the impact of many collisions while maintaining an attractive appearance. The molded body is a single-body construction that is produced by a rotational molding process that will be discussed later.

Figure 1:
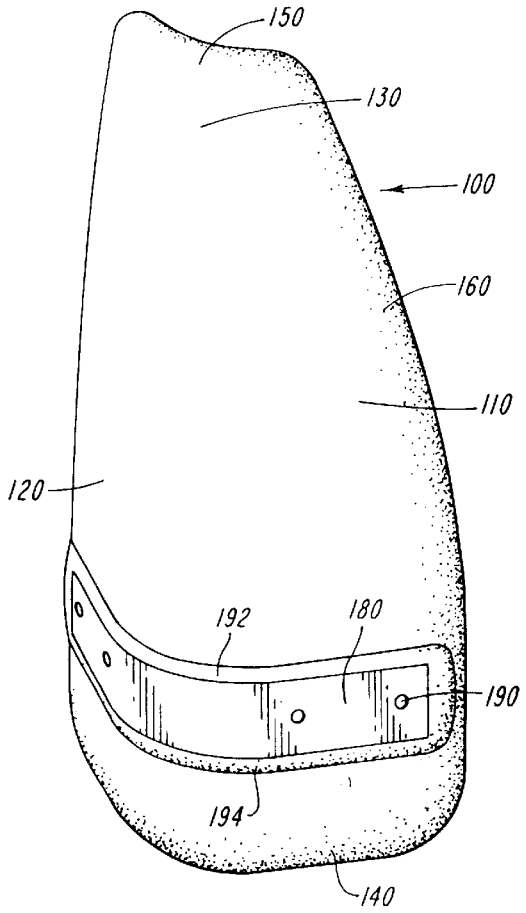
FIG. 1 is a perspective front view of the molded body of the corner guard according to one embodiment of the invention.

Referring to FIG. 1, a front perspective view of the molded body of the present invention for absorbing the impact of collisions and protecting floor fixtures is shown. Molded body 100 includes a front right side face 110 and a front left side face 120. Front right side face 110 and front left side face 120 are substantially orthogonal to each other and meet in a rounded edge 130, but may intersect at other angles other than the perpendicular so as to surround the periphery of the floor fixture. While it is preferable that edge 130 is rounded, other shapes such as a squared off edge may be employed and remain within the scope of the invention. Both front right side face 110 and front left side face 120 provide an extended flat vertical surface that is tapered from the base 140 of molded body 100 to the top 150 of the molded body along the respective right and left side edges 160 and 170 of the molded body 100. While the front right side face 110 and front left side face 120 are preferably tapered from the base 140 to the top 150, other shapes are considered within the scope of the invention. For example, front right side face 110 and front left side face 120 may be rectangular in shape or may be tapered from top 150 toward base 140. Left and right side edges 160 and 170 are preferably beveled as is the top 150 of the molded body 100 and also the base 140 in order to eliminate any sharp edges on the molded body. However, other type edge finishes are considered within the scope of the invention. The front wall formed by the faces 110, 120 and 130 essentially surround the corner of a structure that is to be protected.

In one embodiment of the invention, molded body 100 includes steel rub rail 180 that extends horizontally across the right side face 110 to the left side face 120 of the molded body. Rub rail 180 runs parallel to base 140 and forms a bulge in the front of the molded body, extending outwardly from the front wall, to receive the initial impact of any collision. Rub rail 180 further includes countersunk holes 190 for screws that attach the rub rail 180 to the body 100. Rub rail 180 further includes an upper rounded surface 192 and a lower rounded surface 194. While a rounded rub rail 180 is shown in FIG. 1, it is to be understood that the present invention contemplates other type protrusions such as a wedge or rectangular bulge to also be within the scope of the invention.

Figure 2:
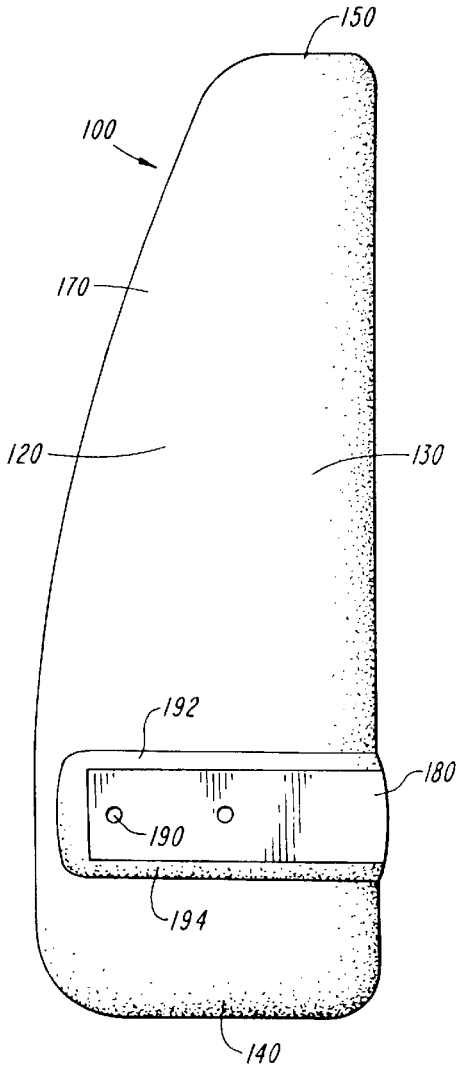
FIG. 2 is a side view of the molded body of FIG. 1.

Referring now to FIG. 2, the vertical height of molded body 100 is designed to be substantially larger than the width of either front right side face 110 or front left side face 120. Rub rail 180, which extends horizontally across the front right face 110 of the molded body to the front left face 120 of the corner is positioned a short distance up from the base 140, and protrudes a short distance out from the respective front right and left faces 110 and 120.

Figure 3:
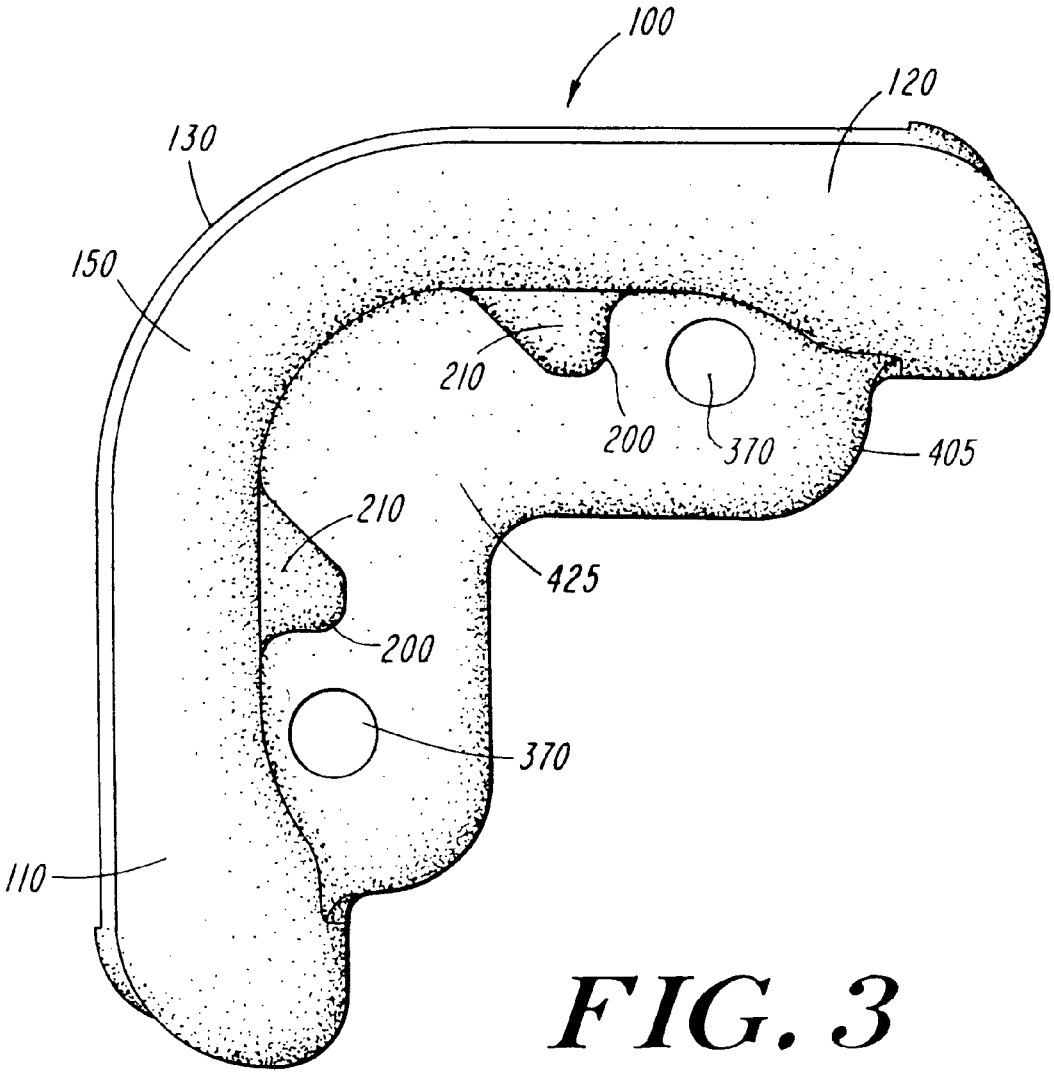
FIG. 3 is a top view of the molded body.

Referring now to FIG. 3, there is shown a top view of the molded body 100. The front right side face 110 extends from base 140 to top 150 of molded body 100 in a tapered fashion. Similarly, the front right side face 110 extends from base 140 to top 150 of the molded body 100 in a tapered fashion.

Figures 4, 4A:
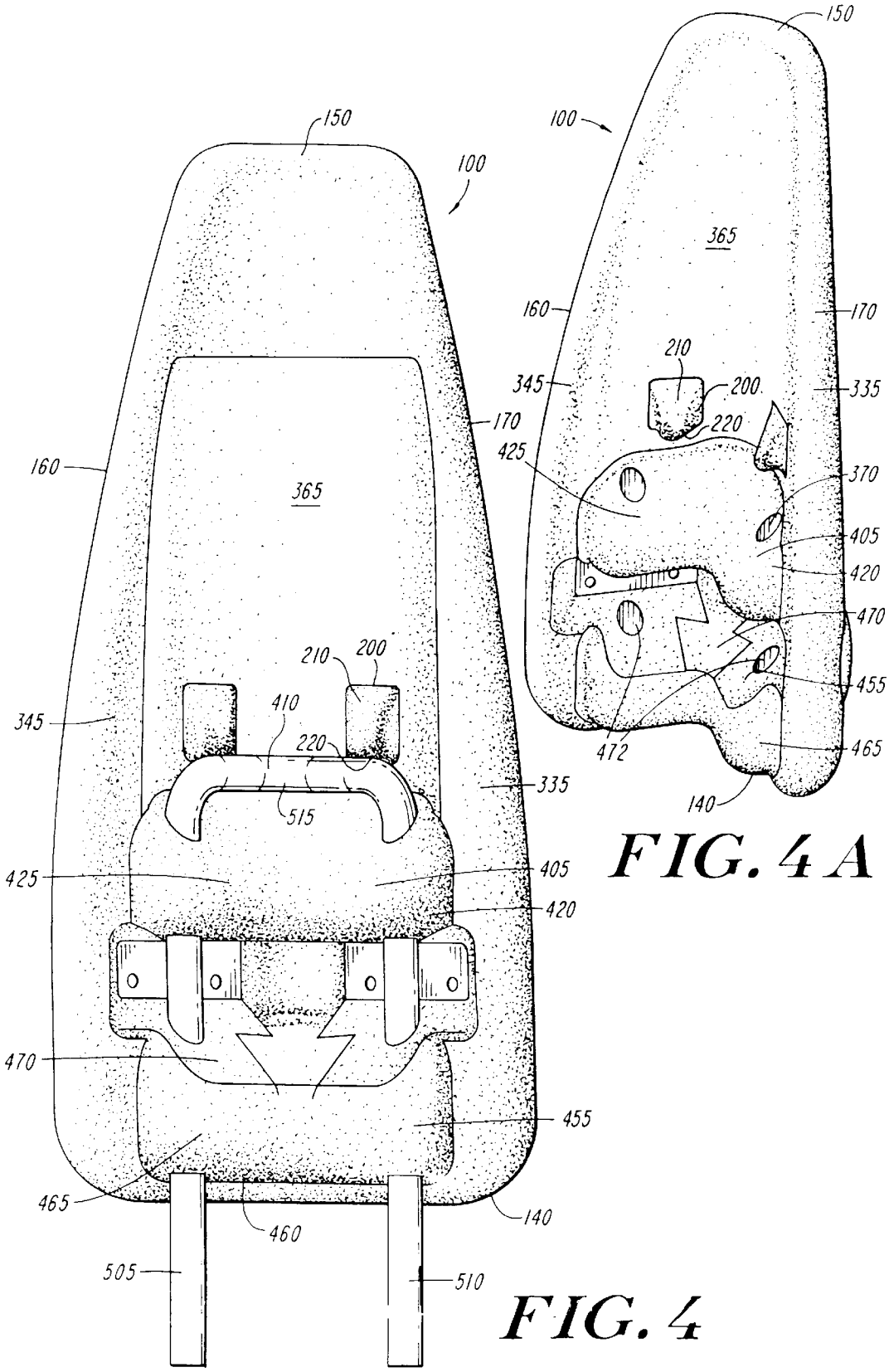
FIG. 4 is a rear view of the molded body.
FIG. 4A is a perspective rear view of the molded body.

FIG. 4 shows a rear view of the molded body 100, with an anchoring and supporting leg structure, and FIG. 4A is a rear perspective view of the corner guard without the leg structure. A continuous rear wall 365 extends from the right trailing edge 345 of the front face 110 to the left trailing edge 335 of the left front face 120. Rear wall 365 is shaped to conform to the corner of the protected structure. Continuous rear wall 365 includes an upper retainer housing 405 for retaining a steel leg structure 410 to support the structure and to anchor molded body 100 to the floor. Upper retaining housing 405 protrudes from the rear wall 365 and has a side wall 420 and roof 425. Holes 370 are provided in the retaining housing 405 for the passing of legs of a steel leg structure 410.

Continuous rear wall 365 also includes a lower retainer housing 455 for further retaining steel leg structure 410 to support in the corner guard and to anchor molded body 100 to the floor. Lower retainer housing 455 protrudes from the rear wall 365 and has a housing floor 460, sidewall 465 and roof 470. Holes 472 are provided through lower retainer housing 455 for passage of steel leg structure 410.

Extending from the rear wall 365 of the corner guard a distance above the upper retainer housing 405 are a pair of projections 200. The projections, or stops, have a ramp-like upper surface 210 and a horizontal bottom surface 220 for capturing the leg structure 410.

Figure 5C:
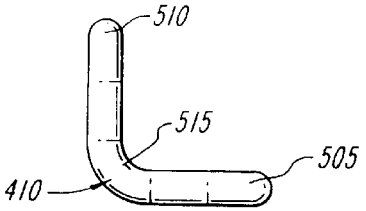
FIG. 5C is a top view of the leg structure.
Figure 5B:
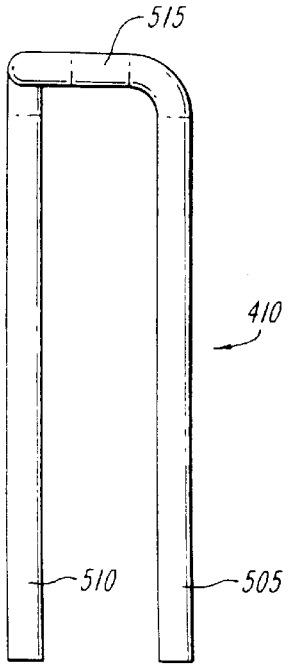
FIG. 5B is a side view of the leg structure.
Figure 5A:
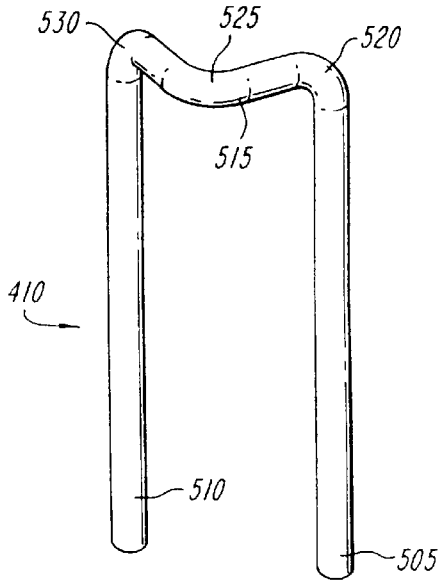
FIG. 5A is a perspective view of a leg structure for anchoring the molded body to a floor.

Referring now to FIGS. 5A, 5B, and 5C detail of the steel leg structure 410 is shown. The leg structure 410 includes two extending legs 505 and 510 that are connected by bridge 515. Leg structure 410 is preferably fabricated from stainless steel to provide strength when molded body 100 receives an impact blow. Other materials may, of course, be utilized as long as the appropriate strength is retained, and leg structure 410 does not break under impact. Bridge, or connector, 515 consists of three bent sections 520, 525, and 530 to form a bow type shape, but other configurations such as a V-shape are contemplated to be within the scope of the invention.

As mentioned previously, the molded body 100 is fabricated using a rotational molding process. In this process, a hollow mold is created that has inside surfaces that conform exactly to the exterior surfaces of molded body 100. When the molding material, which is preferably low-density polyethylene in the present invention is introduced into the hollow mold, the mold is rotationally spun to coat the inner surfaces of the mold. Upon hardening the molded body 100 is created. As a result of using this process, the molded body 100 of the present invention is hollow throughout, thus making the corner guard lightweight and yet impact resistant. While in the preferred embodiment of the invention a hollow molded body is envisioned, one of ordinary skill in the art will recognize that certain portions of the molded body 100 may be solidly filled with other portions hollow, and still remain within the scope of the invention. Furthermore, the molded body 100 is advantageously of a single-body construction and less costly to fabricate than the conventional aluminum rails. Because the molded body 100 of the present corner guard is fabricated from a plastic it easy to clean and has a pleasing and attractive appearance.

Figure 6:
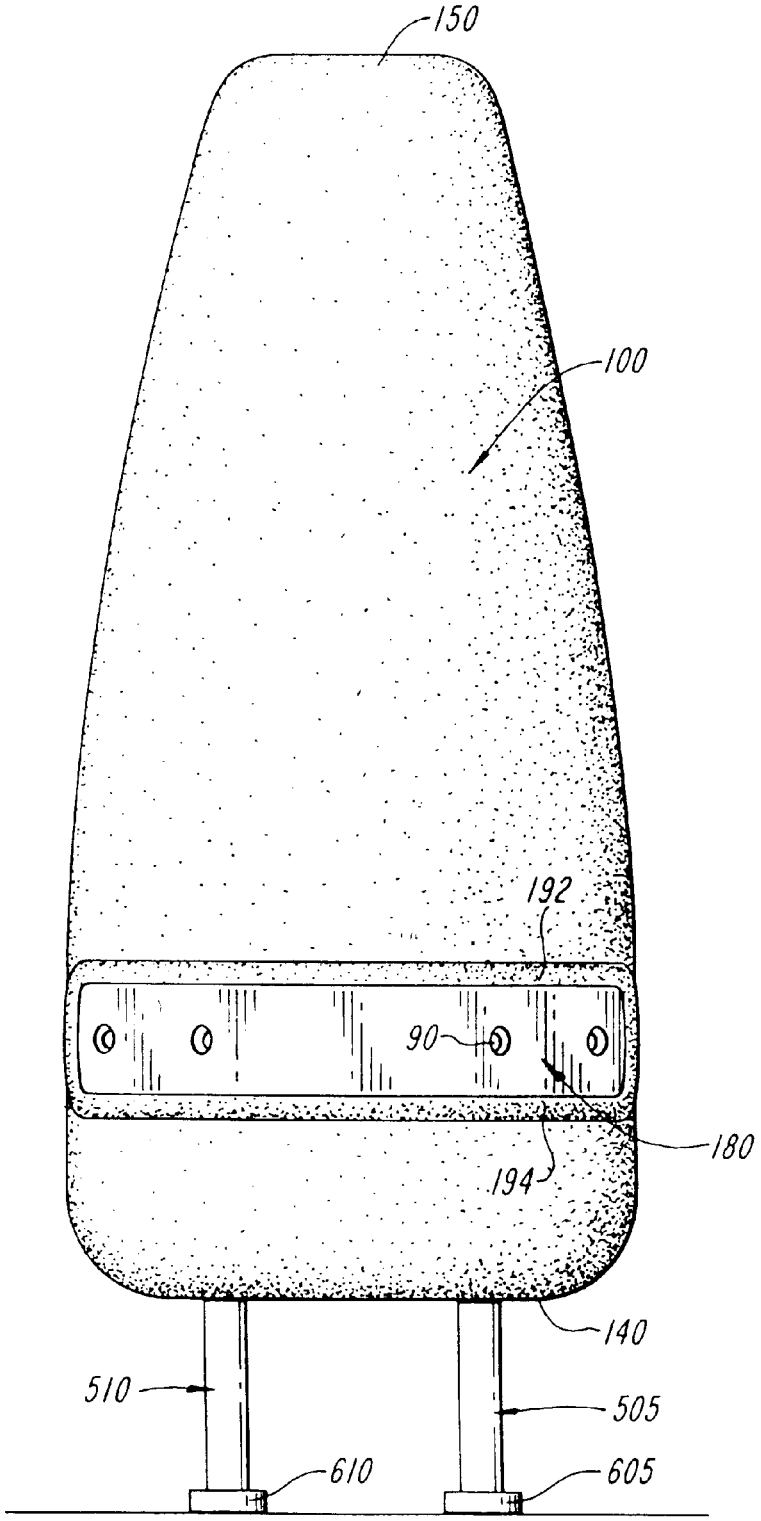
FIG. 6 shows the corner guard anchored into sockets in a floor.

In operation, steel leg structure 410 is inserted into the holes of the upper and lower retainer housings 405 and 455 just after the body 100 comes out of the mold and is still warm. The connector formed by bent section 525 is pressed against the rear wall 365 of molded body 100 and is captured beneath the projections 200. As the body 100 of the corner guard cools, it shrinks somewhat and the steel leg structure 410 is gripped more firmly but the retainer housing 405, 455. The steel leg structure 410 therefor supplies a backbone of sorts, to add structural support to the softer, more resilient body 100. The assembled corner guard comprising the molded body 100 and the leg structure 410 is anchored to the floor in front of a corner of a floor fixture by inserting the legs 505 and 510 into flanged sockets 605 and 610 that are cemented into the floor as shown in FIG. 6. Other type of attachments are contemplated such as cementing the legs of leg structure 410 directly to the floor.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

What is claimed is:

1. A corner guard for protecting corners of structures from collision with objects, comprising:

a hollow plastic body having a rear wall shaped to conform to the corner of a protected structure, and a front wall shaped to surround said corner, and a leg structure secured to said rear wall, said leg structure including at least one leg portion for supporting said corner guard on the floor.

2. The corner guard of claim 1 further including a horizontal rail secured to and extending outwardly from said front wall.

3. The corner guard of claim 2 wherein said rail is metal.

4. The corner guard of claim 1 wherein said hollow plastic body is fabricated from low-density polyethylene.

5. The corner guard of claim 1 wherein said leg structure comprises an integral unit having at least a pair of vertical legs and a horizontal connector joining said pair of legs, said horizontal connector abutting said rear wall.

6. The corner guard of claim 5 wherein said rear wall includes a projecting retainer housing with vertical passages for passage of said pair of vertical legs.

7. The corner guard of claim 6 wherein said rear wall includes a projecting stop for engaging said leg structure.

8. A corner guard for protecting corners of structures from collision with objects, comprising:

a hollow body fabricated of low-density polyethylene having a rear wall shaped to conform to the corner of a protected structure, and a front wall shaped to surround said corner, and a metal leg structure for supporting and strengthening said hollow body, comprising at least a pair of vertical legs and a horizontal connector joining said pair of legs, said rear wall including a projecting retainer housing with vertical passages for passage of said pair of vertical legs, said horizontal connector abutting said rear wall, and including a projecting stop for engaging said leg structure, further including a horizontal metal rail secured to and having a surface extending outwardly from said front wall.

* * * * *